US008241051B2

(12) United States Patent
Yi et al.

(10) Patent No.: US 8,241,051 B2
(45) Date of Patent: Aug. 14, 2012

(54) SYSTEM AND METHOD FOR SEALING A CONNECTOR

(75) Inventors: Chong Hun Yi, Mechanicsburg, PA (US); Matthew Richard McAlonis, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 9 days.

(21) Appl. No.: 12/841,602

(22) Filed: Jul. 22, 2010

(65) Prior Publication Data

US 2012/0021631 A1 Jan. 26, 2012

(51) Int. Cl.
*H01R 13/52* (2006.01)

(52) U.S. Cl. ..... 439/271

(58) Field of Classification Search ..... 439/271–272, 439/556, 559

See application file for complete search history.

(56) References Cited

U.S. PATENT DOCUMENTS

| | | | | |
|---|---|---|---|---|
| 5,080,601 | A * | 1/1992 | Mennekes et al. | 439/314 |
| 5,277,610 | A * | 1/1994 | Krehbiel et al. | 439/271 |
| 5,722,610 | A * | 3/1998 | Smith et al. | 242/342 |
| 6,338,651 | B1 * | 1/2002 | Svette et al. | 439/559 |
| 6,702,593 | B2 * | 3/2004 | Ogawa | 439/79 |
| 7,182,637 | B2 * | 2/2007 | Coyle et al. | 439/557 |
| 2008/0137306 | A1 * | 6/2008 | Kim | 361/709 |

* cited by examiner

*Primary Examiner* — Renee S Luebke

(57) ABSTRACT

A connector assembly includes a connector having a connector housing including a flange and a mating end. The flange has a flange surface. The mating end has an opening extending therethrough. A flange seal extends along the flange surface. A mating end seal extends around the mating end of the connector housing. The connector housing is configured to couple to a panel so that a flange side of the panel is positioned adjacent the flange surface of the connector housing. The mating end of the connector housing is configured to extend through an opening formed in the panel. The flange seal is configured to be positioned between the flange surface of the connector housing and the flange side of the panel. The mating end seal is configured to be positioned between the panel and the mating end of the connector housing to seal the opening of the panel.

20 Claims, 11 Drawing Sheets

SYSTEM AND METHOD FOR SEALING A CONNECTOR

BACKGROUND OF THE INVENTION

The subject matter described herein relates generally to an electrical connector and, more particularly, to a system and method for sealing an electrical connector.

Electronic devices generally include several input and output connectors. The connectors are configured to engage a compatible connector of an external device. The connectors are typically mounted on an outer housing of the electronic device. A mating end of the connector is positioned on the outer housing and accessible to the connector of the external device. A circuitry end of the connector is configured to engage a substrate within the housing of the electronic device. The housing of the electronic device protects the circuitry of the connector and the substrate.

However, current connectors are not without their disadvantages. Often, the electronic device is exposed to water. For example, the electronic device may be used within a water vehicle. Other electronic devices are exposed to chemicals that are used to clean the device. When the electronic device is exposed to liquids, the liquids may leak into the housing and contact the substrate of the electronic device and/or the circuitry of the connector. Exposure to liquids may short the connector and/or substrate causing the electronic device to malfunction and/or become permanently damaged.

A need remains for a connector assembly that provides sealing with an electronic device.

SUMMARY OF THE INVENTION

In one embodiment, a connector assembly is provided. The assembly includes a connector having a connector housing including a flange and a mating end extending from the flange. The flange has a flange surface. The mating end has an opening configured to receive an electrical contact therethrough. A flange seal extends along the flange surface. A mating end seal extends around the mating end of the connector housing. The connector housing is configured to couple to a panel so that a flange side of the panel is positioned adjacent the flange surface of the connector housing. The mating end of the connector housing is configured to extend through an opening formed in the panel. The flange seal is configured to be positioned between the flange surface of the connector housing and the flange side of the panel. The mating end seal is configured to be positioned between the panel and the mating end of the connector housing to seal the opening of the panel.

In another embodiment, a connector assembly is provided. The assembly includes a connector having a connector housing including a flange and a mating end extending from the flange. The flange has a flange surface. The mating end having an opening configured to receive an electrical contact therethrough. A seal is joined to the connector housing and configured to seal the connector housing to a panel. The seal includes metal particles to provide electromagnetic shielding for the electrical contact. The connector housing is configured to be coupled to the panel so that a flange side of the panel is positioned adjacent the flange surface of the connector housing. The mating end of the connector housing is configured to extend through an opening formed in the panel.

In another embodiment, a connector assembly is provided. The assembly includes a first connector having a connector housing including a flange and a mating end extending from the flange. The flange has a flange surface. The mating end has an opening configured to receive an electrical contact therethrough. A flange seal extends along the flange surface. A mating end seal extends around the mating end of the connector housing. The first connector is configured to couple to a first panel so that a flange side of the panel is positioned adjacent the flange surface of the connector housing. The mating end of the connector housing is configured to extend through an opening formed in the panel. The flange seal is configured to be positioned between the flange surface of the connector housing and the flange side of the panel. The mating end seal is configured to be positioned between the panel and the mating end of the connector housing to seal the opening of the panel. The assembly also includes a second connector configured to engage the first connector. The second connector has a second connector housing configured to coupled to a second panel. A second connector seal is configured to be positioned between the second connector panel and the second connector housing.

BRIEF DESCRIPTIONS OF THE DRAWINGS

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
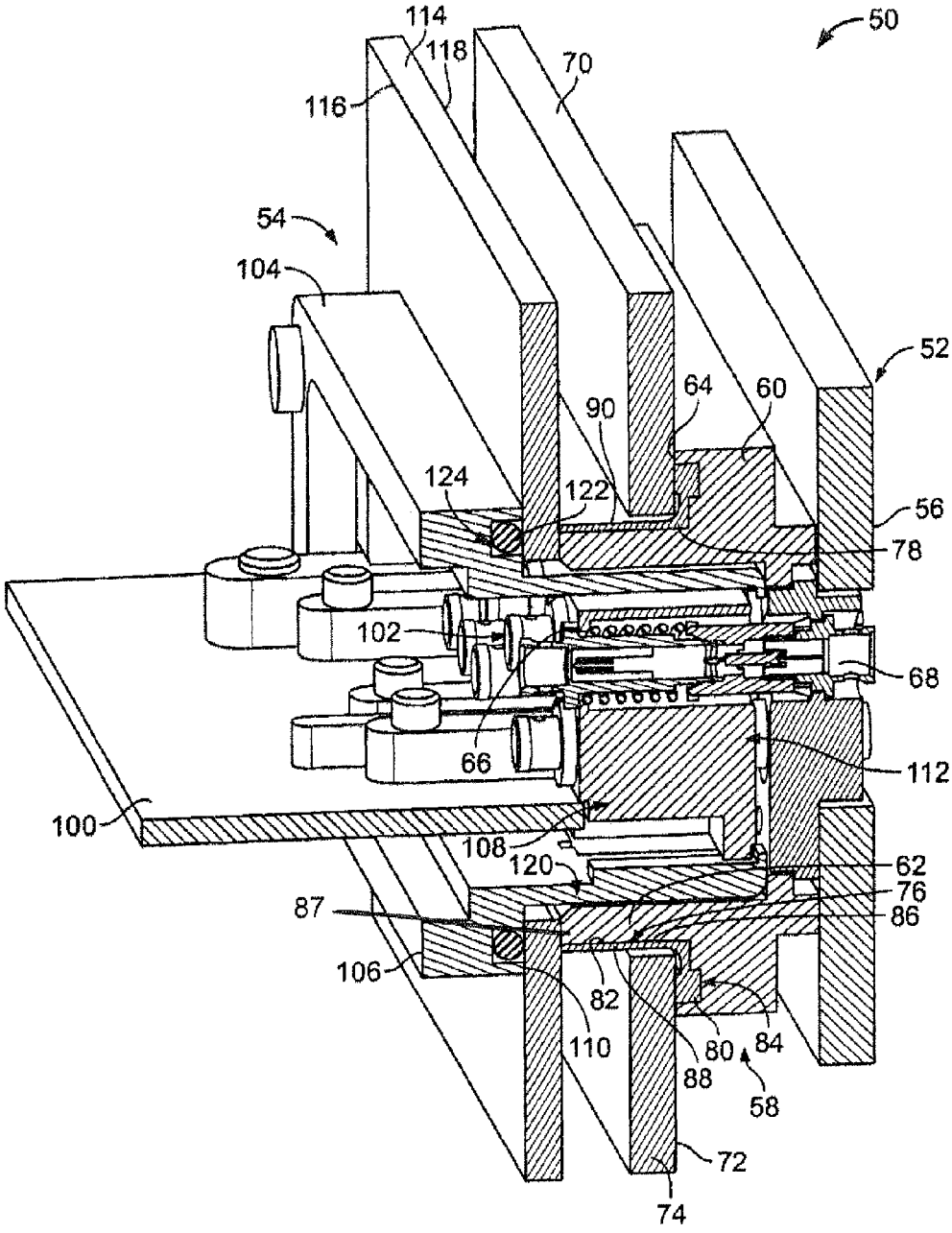
FIG. 1 is a cross-sectional view of a connector assembly formed in accordance with an embodiment.

FIG. 1 illustrates a connector assembly 50 having a connector 52 and a connector 54. In the exemplary embodiment, the connectors 52 and 54 are high speed connectors. The connector 54 is configured to be inserted into an electronic device. The electronic device may be exposed to liquids, for example, water and/or chemicals. The connector 52 engages the connector 54 to create an electrical connection therebetween. Data and/or power signals are transmitted between the connector 52 and the connector 54.

The connector 52 is joined to a substrate 56. The substrate 56 may be a circuit board or a printed circuit board. For example, the substrate 56 may be a backplane circuit board, a midplane circuit board, a mother board, a daughter card, or the like. The substrate 56 includes an electrical contact 68 joined thereto. The connector 52 includes a housing 58 having a flange 60 and a mating end 62. The flange 60 may be joined to the substrate 56. The flange 60 may be surface mounted, press-fit, soldered, or the like to the substrate 56. The flange 60 includes a flange surface 64. The mating end 62 of the connector housing 58 extends from the flange 60. The mating end 62 has an opening 66 extending therethrough. The electrical contact 68 extends through the opening 66 formed in the mating end 62.

A panel 70 engages the flange 60 of the connector housing 58. The panel 70 has a flange side 72 and a mating side 74. The panel 70 is secured to the flange 60 of the connector housing 58 so that the flange side 72 of the panel 70 is positioned adjacent the flange surface 64 of the flange 60. The panel 70 may be secured to the flange 60 with screws, a press-fit mechanism, or the like. An opening 76 extends through the panel 70. The mating end 62 of the connector housing 58 extends through the opening 76 formed in the panel 70.

A seal 78 is joined to the connector housing 58. The seal 78 is joined to the connector housing 58 using an over-molding process, wherein the connector housing 58 is positioned in a mold and a seal material is injected into the mold to form the seal 78 around the housing 58. Optionally, the seal 78 may frictionally engage the connector housing 58. Alternatively, the seal 78 may be bonded to the connector housing 58. In one embodiment, the seal 78 is a conductive ethylene propylene diene monomer. Optionally, the seal 78 may be a fluorosilicone rubber. In one embodiment, the seal 78 includes metal particles. For example, the seal 78 may be impregnated with passivated silver plated aluminum particles. Optionally, the seal 78 may be formed from any suitable sealing material. The seal 78 includes metal particles to provide electromagnetic shielding for the connector 52. The seal 78 includes a flange seal 80 and a mating end seal 82. The flange seal 80 and the mating end seal 82 are formed integrally. Optionally, the flange seal 80 may be separated from the mating end seal 82.

The flange seal 80 extends along the flange surface 64 of the connector housing 58. In the illustrated embodiment, the flange surface 64 includes a groove 84. The flange seal 80 is positioned within the groove 84. The flange seal 80 may be frictionally held within the groove 84. Optionally, the flange seal 80 may be bonded within the groove 84. The flange seal 80 may include protrusions, grooves, ribs, or the like. The flange seal 80 is positioned between the flange surface 64 of the connector housing 58 and the flange side 72 of the panel 70. The flange seal 80 forms a water tight seal between the flange 60 of the connector housing 58 and the panel 70. The flange seal 80 is configured to prevent liquids, such as water and/or chemicals, from entering the electronic device. Alternatively, the flange seal 80 may form an air tight seal between the flange 60 of the connector housing 58 and the panel 70.

The mating end seal 82 extends along the mating end 62 of the connector housing 58. The mating end 62 of the connector housing 58 includes an outer surface 86 and a front face 87. The mating end seal 82 is joined to the outer surface 86 and front face 87 of the mating end 62. The mating end seal 82 may be frictionally retained on the outer surface 86. Optionally, the mating end seal 82 may be bonded to the outer surface 86 of the mating end 62. The mating end seal 82 may include protrusions, grooves, ribs, or the like. The mating end seal 82 is positioned between the panel 70 and the mating end 62. In the illustrated embodiment, a portion 88 of the mating end seal 82 extends past the panel 70 and along the front face 87 of the mating end 62 of the connector housing 58. The panel 70 includes an inner surface 90 that defines the opening 76 formed in the panel 70. The mating end seal 82 is positioned between the inner surface 90 of the panel 70 and the outer surface 86 of the mating end 62 of the connector housing 58. The mating end seal 82 provides a water tight seal between the mating end 62 of the connector housing 58 and the panel 70. The mating end seal 82 is configured to seal the opening 76 formed in the panel 70 to prevent liquids, such as water and/or chemicals from entering the electronic device. Alternatively, the mating end seal 82 may form an air-tight seal between the mating end 62 of the connector housing 58 and the panel 70.

The connector 54 is joined to a substrate 100. The substrate 100 may be a circuit board or a printed circuit board. For example, the substrate 100 may be a backplane circuit board, a midplane circuit board, a mother board, a daughter card, or the like. The substrate 100 includes an electrical contact 102 joined thereto. The electrical contact 102 is configured to engage the electrical contact 68 of the connector 52. The connector 54 includes a housing 104 having a flange 106 and a mating end 108. The flange 106 may be joined to the substrate 100. The flange 106 may be surface mounted, press-fit, soldered, or the like to the substrate 100. The flange 106 includes a flange surface 110. The mating end 108 of the connector housing 104 extends from the flange 106. The mating end 108 has an opening 112 extending therethrough. The electrical contact 102 extends into the mating end 108 and is accessible through the opening 112 formed in the mating end 108. The mating end 108 of the connector 54 is received within the mating end 62 of the connector 52 so that the electrical contact 102 engages the electrical contact 68.

A panel 114 engages the flange 106 of the connector housing 104. The panel 114 has a flange side 116 and a mating side 118. The panel 114 is secured to the flange 106 of the connector housing 104 so that the flange side 116 of the panel 114 is positioned adjacent the flange surface 110 of the flange 106. The panel 114 may be secured to the flange 106 with screws, a press-fit mechanism, or the like. An opening 120 extends through the panel 114. The mating end 108 of the connector housing 104 extends through the opening 120 formed in the panel 114. When the connector 52 is engaged with the connector 54, the mating side 118 of the panel abuts the mating end 62 of the connector 52. The mating end seal 82 forms a water tight interface between the connector 52 and the connector 54. Alternatively, the mating end seal 82 forms an air tight interface between the connector 52 and the connector 54.

A seal 122 is joined to the connector housing 104. In one embodiment, the seal 122 is over-molded to the connector housing 104. The seal 122 is positioned along the flange 106 of the connector housing 104. In one embodiment, the seal 122 may be a conductive ethylene propylene diene monomer o-ring having a 0.07 inch radius. Optionally, the seal 122 may be a fluorosilicone rubber. The seal 122 may include metal particles, for example passivated silver plated aluminum particles. Alternatively, the seal 122 may have any shape and be configured from any suitable sealing material. In the illustrated embodiment, the flange 106 of the connector housing 104 includes a groove 124. The seal 122 is positioned within the groove 124. The seal 122 may be frictionally held within the groove 124. Optionally, the seal 122 may be bonded within the groove 124. In another embodiment, the flange 106 does not include the groove 124. In such an embodiment, the seal 122 is frictionally retained on or bonded to the flange surface 110 of the flange 106. The seal 122 is positioned between the flange surface 110 of the connector housing 104 and the flange side 116 of the panel 114. The seal 122 creates a water tight interface between the connector housing 104 and the panel 114. The seal 122 is configured to prevent liquids, such as water and/or chemicals from entering the connector 54. Alternatively, the seal 122 may create an air tight interface between the connector housing 104 and the panel 114.

Figure 2:
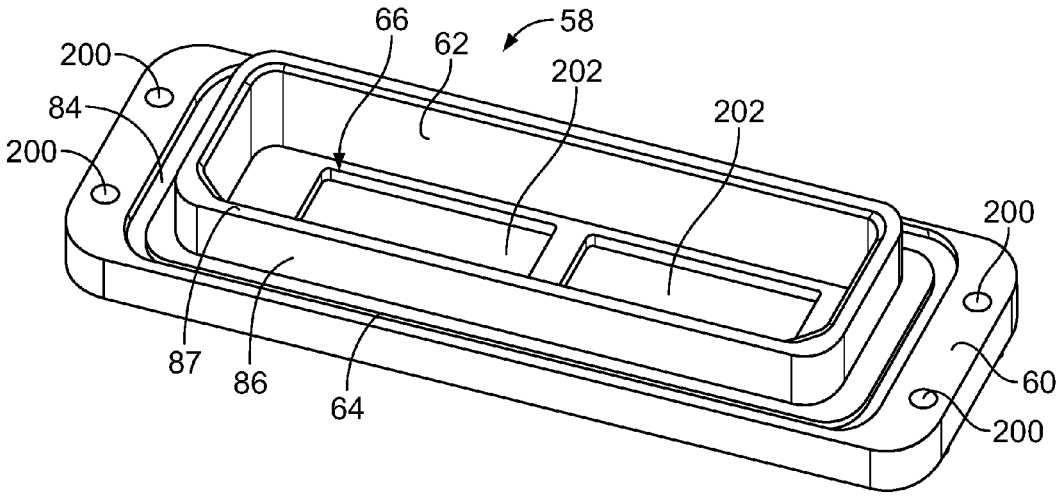
FIG. 2 is a view of the connector housing, shown in FIG. 1.

FIG. 2 illustrates the connector housing 58. The connector housing 58 may be formed from aluminum and include electroless nickel plating. The connector housing 58 includes the flange 60. The flange 60 is configured to engage the electronic device. The flange 60 includes apertures 200 formed therein. The flange 60 may be coupled to the electronic device with screws inserted into the apertures 200. The apertures 200 may also receive screws to join the panel 70 (shown in FIG. 1) to the flange 60. The flange 60 includes an opening 202. The electrical contact 68 of the electronic device is configured to extend through the opening 202 formed in the flange 60. In the illustrated embodiment, the flange includes two openings 202. Each opening 202 is configured to receive an electrical contact 68 therethrough. Alternatively, the flange 60 may include any number of openings 202 to receive any number of electrical contacts 68. The flange 60 has a flange surface 64 that includes the groove 84. The groove 84 is configured to receive the flange seal 80 therein. Optionally, the flange seal 80 may be frictionally held to or bonded to the flange surface 64.

The mating end 62 of the connector housing 58 extends from the flange 60. The mating end 62 surrounds the openings 202 formed in the flange 60. The mating end 62 includes an outer surface 86 and a front face 87. The mating end seal 82 is configured to extend along the outer surface 86 and the front face 87. The opening 66 extends through the mating end 62. The electrical contact 68 is configured to extend into the opening 66 formed in the mating end 62. The electrical contact 68 is configured to be housed within the mating end 62 of the connector housing 58.

Figure 3:
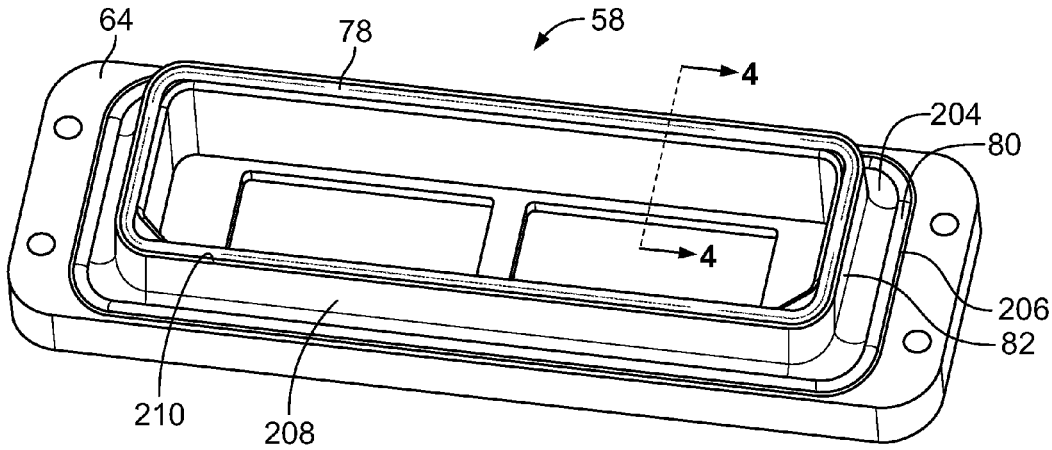
FIG. 3 is a view of the connector housing and the seal, shown in FIG. 1.

FIG. 3 illustrates the connector housing 58 having the seal 78 joined thereto. The seal 78 includes the flange seal 80 and the mating end seal 82. The flange seal 80 and the mating end seal 82 are formed integrally. The flange seal 80 extends along the flange surface 64 of the flange 60. The flange seal 80 includes a surface portion 204 and a ring portion 206. The ring portion 206 is positioned within the groove 84 formed in the flange surface 64. The ring portion 206 may be frictionally engaged with the groove 84 and or bonded therein. The ring portion 206 has a rounded surface. Alternatively, the ring portion 206 may have any configuration. The surface portion 204 of the flange seal 80 extends along the flange surface 64 of the flange 60. The flange seal 80 extends around the mating end 62 of the connector housing. In one embodiment, the flange seal 80 may include protrusions, ribs, grooves, or the like.

The mating end seal 82 includes an outer surface portion 208 and a front face portion 210. The outer surface portion 208 is joined to the surface portion 204 of the flange seal 80. The outer surface portion 208 extends around the outer surface 86 of the mating end 62 of the connector housing 58. The front face portion 210 extends from the outer surface portion 208. The front face portion 210 extends along the front face 87 of the mating end 62. The front face portion 210 has rounded surface. Alternatively, the front face portion 210 may have any configuration. In one embodiment, the mating end seal 82 may include protrusions, ribs, grooves, or the like.

Figure 4:
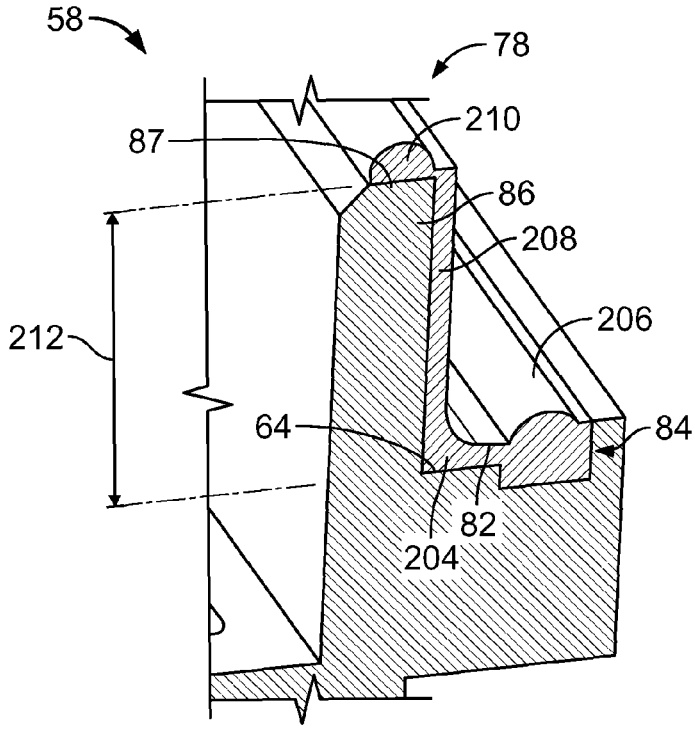
FIG. 4 is a cross-sectional view of the connector housing and the seal taken along the line 4-4, shown in FIG. 3.

FIG. 4 is a cross-sectional view of the connector housing 58 and the seal 78 taken along the line 4-4 of FIG. 3. The ring portion 206 of the flange seal 80 is retained within the groove 84 formed in the flange surface 64. The surface portion 204 of the flange seal 80 extends along the flange surface 64 of the flange 60 and joins the outer surface portion 208 of the mating end seal 82. The outer surface portion 208 of the mating end seal 82 is positioned along the outer surface 86 of the mating end 62. In one embodiment, the outer surface 86 of the mating end 62 has a length 212 of approximately 5 mm. Optionally, the outer surface 86 of the mating end 62 may have a length smaller than or larger than 5 mm. The front face portion 210 of the mating end seal 82 extends from the outer surface portion 208 and along the front face 87 of the mating end 62. In one embodiment, the front face portion 210 of the mating end seal 82 has a rounded surface of approximately 0.07 inches in radius. The seal 78 creates a water tight interface around the connector housing 58. The seal 78 prevents liquids from entering the electronic device. In one embodiment, the seal 78 creates an air tight interface around the connector housing 58. The seal 78 provides electromagnetic shielding for the connector housing 58.

Figure 5:
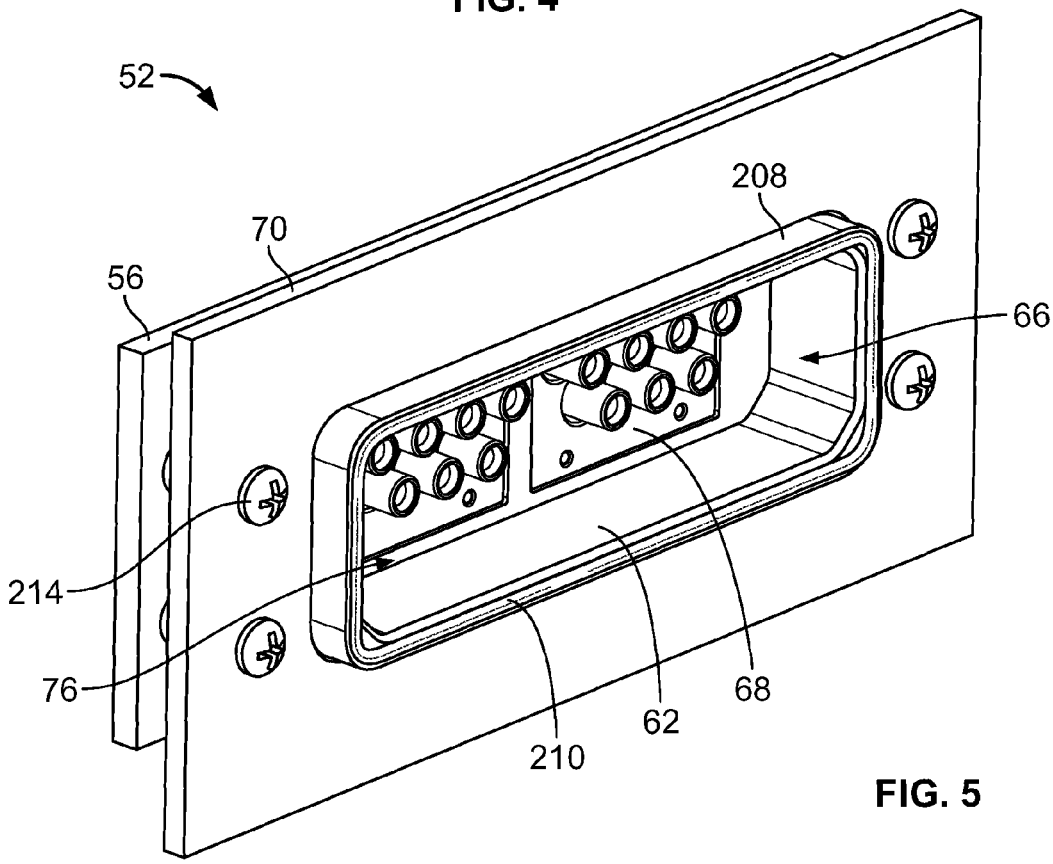
FIG. 5 is a view of one of the connectors, shown in FIG. 1.

FIG. 5 illustrates the connector 52. The connector 52 is assembled so that the substrate 56 is aligned in parallel to the panel 70. Alternatively, the substrate 56 may be aligned in any orientation with respect to the panel 70. The panel 70 is secured to the connector housing 58 with screws 214. Alternatively, the panel 70 may be press-fit, soldered, or the like to the connector housing 58. The panel 70 and the connector housing 58 are sealed by the flange seal 80. The mating end 62 of the connector housing 58 extends through the opening 76 formed in the panel 70. The outer surface portion 208 of the mating end seal 82 provides a water tight interface between the outer surface 86 of the mating end 62 of the connector housing 58 and the inner surface 90 of the panel 70. Alternatively, the mating end seal 82 forms an air tight interface between the connector housing 58 and the panel 70. The mating end seal 82 provides electromagnetic shielding between the connector housing 58 and the panel 70.

The mating end 62 of the housing connector 58 surrounds the electrical contact 68. The electrical contact 68 is positioned within the opening 66 formed in the mating end 62 of the housing connector 58. The electrical contact 68 is configured to engage the electrical contact 102 of the connector 54. When the connector 52 is engaged with the connector 54, the front face portion 210 of the mating end seal 82 is configured to engage the panel 114 of the connector 54 to form a water tight and/or air tight interface between the connector 52 and the connector 54. The mating end seal 82 provides electromagnetic shielding between the connector 52 and the connector 54.

Figure 6:
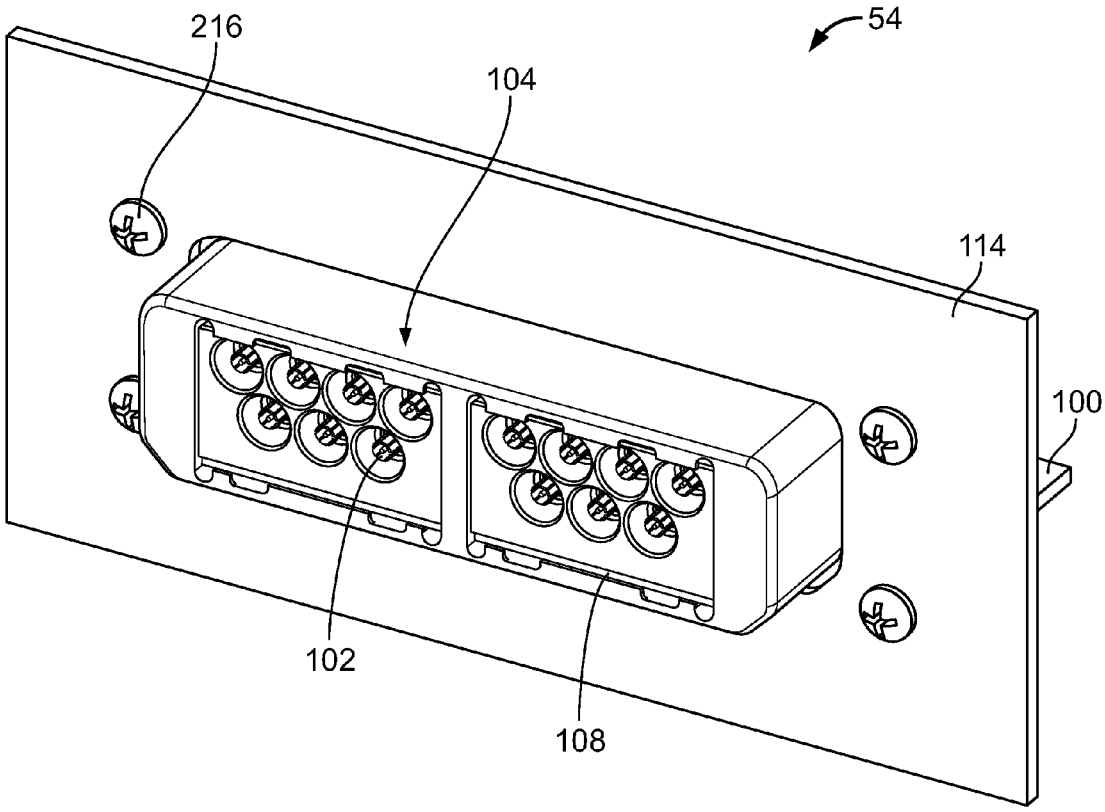
FIG. 6 is a view of the other connector, shown in FIG. 1.

FIG. 6 illustrates the connector 54. The substrate 100 extends perpendicularly with respect to the panel 114. Alternatively, the substrate 100 may have any orientation with respect to the panel 114. The panel 114 is coupled to the connector housing 104 and sealed thereto with the seal 122. In the illustrated embodiment, the panel 114 is attached to the connector housing 104 with screws 216. Alternatively, the panel 114 may be press-fit, soldered, or the like to the connector housing 104. The mating end 108 of the connector housing 104 extends through the opening 120 formed in the panel 114. The electrical contact 102 is housed within the mating end 108 of the connector housing 104. The electrical contact 102 is configured to engage the electrical contact 68 of the connector 52. When the connector 52 engages the connector 54, the front face portion 210 of the mating end seal 82 is configured to engage the panel 114 of the connector 54 to form a water tight and/or air tight interface between the connector 52 and the connector 54.

Figure 7:
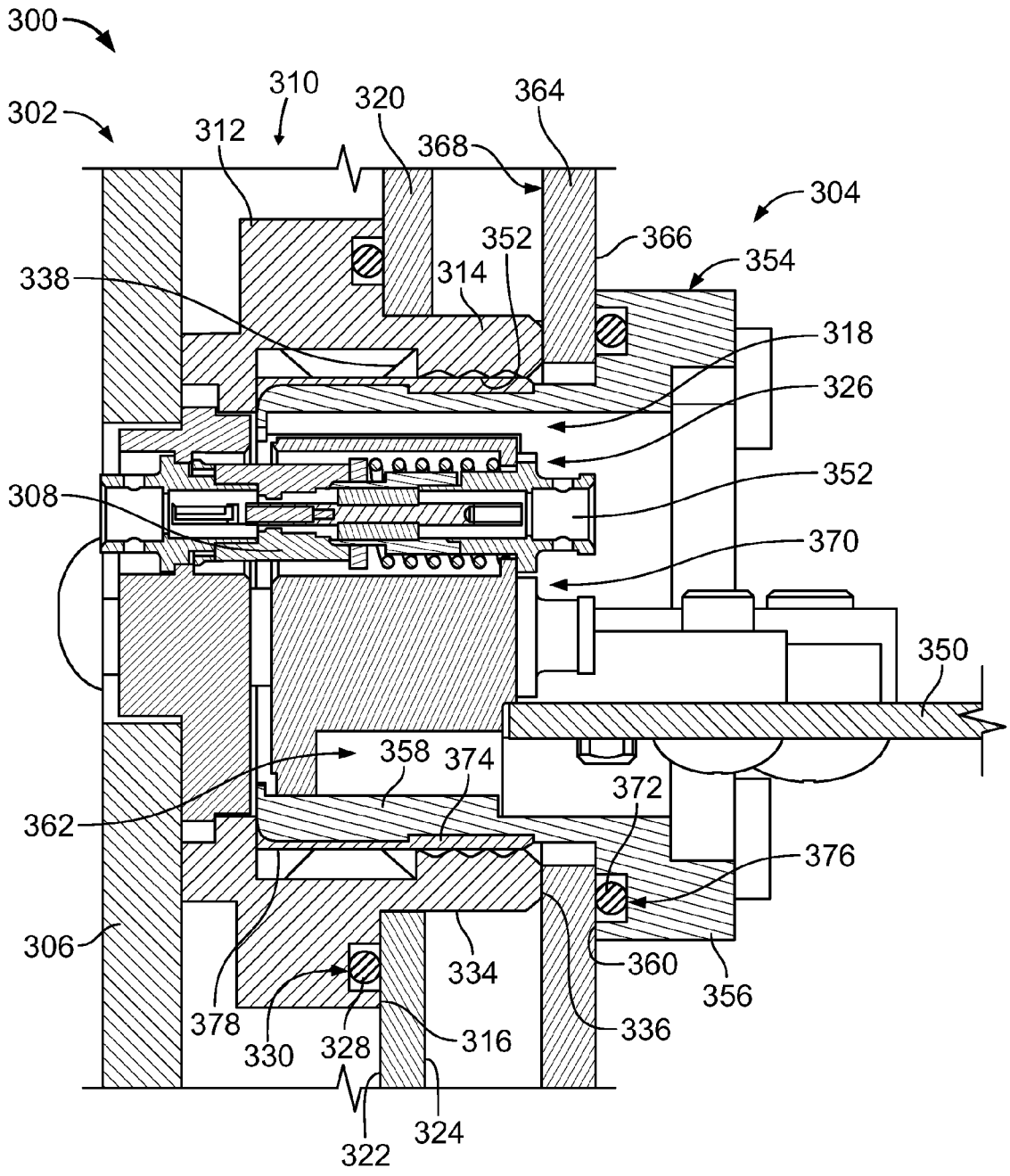
FIG. 7 is a view of another connector assembly formed in accordance with an embodiment.

FIG. 7 illustrates another connector assembly 300 having a connector 302 and a connector 304. In one embodiment, the connectors 302 and 304 are high speed connectors. The connector 304 is configured to be inserted into an electronic device. The electronic device may be exposed to liquids, for example, water and/or chemicals. The connector 302 engages the connector 304 to create an electrical connection therebetween. Data and/or power signals are transmitted between the connector 302 and the connector 304.

The connector 302 is joined to a substrate 306 having an electrical contact 308 joined thereto. The connector 302 includes a housing 310 having a flange 312 and a mating end 314. The flange 312 includes a flange surface 316. The mating end 314 of the connector housing 310 extends from the flange 312. The mating end 314 has an opening 318 extending therethrough. The electrical contact 308 extends through the opening 318 formed in the mating end 314. The electrical contact 308 is housed in the mating end 314 of the connector housing 310. The mating end 314 includes an inner surface 332, an outer surface 334, and a front face 336. The inner surface 332 includes contacts 338. In one embodiment, the contacts 338 are formed from metal and are configured to provide electromagnetic shielding for the connector assembly 300. In one embodiment, the contacts 338 may be formed as conductive springs.

A panel 320 engages the flange 312 of the connector housing 310. The panel 320 has a flange side 322 and a mating side 324. The panel 320 is secured to the flange 312 of the connector housing 310 so that the flange side 322 of the panel 320 is positioned adjacent the flange surface 316 of the flange 312. An opening 326 extends through the panel 320. The mating end 314 of the connector housing 310 extends through the opening 326 formed in the panel 320.

Figure 8:
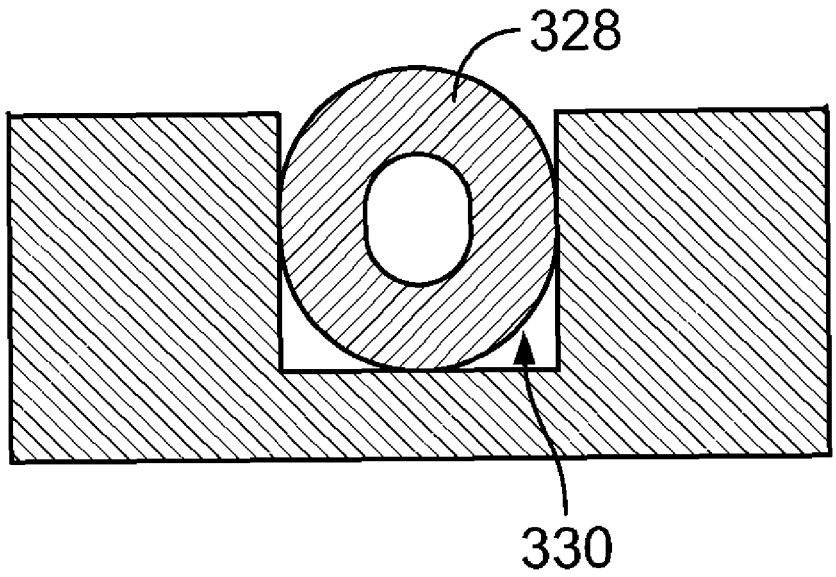
FIG. 8 is a cross-sectional view of an embodiment of the seal, shown in FIG. 7, positioned within the groove, shown in FIG. 7.
Figure 9:
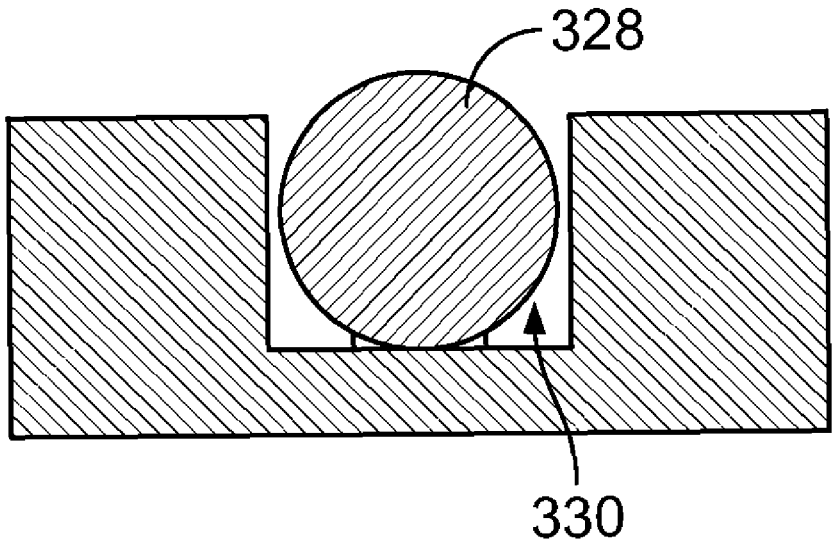
FIG. 9 is a cross-sectional view of another embodiment of the seal, shown in FIG. 7, positioned within the groove, shown in FIG. 7.

A seal 328 is positioned along the flange 312 of the connector housing 310. The seal 328 may be over-molded to the connector housing 310. In one embodiment, the seal 328 may be a conductive ethylene propylene diene monomer o-ring having a 0.07 inch radius. Optionally, the seal 328 may be a fluorosilicone rubber. The seal 328 may include metal particles, for example passivated silver plated aluminum particles. Alternatively, the seal 328 may have any shape and be configured from any suitable sealing material. In the illustrated embodiment, the flange 312 of the connector housing 310 includes a groove 330. The seal 328 is positioned within the groove 330. In one embodiment, the seal 328 is a hollow ring, as illustrated in FIG. 8. In such an embodiment, the seal 328 may be frictionally held within the groove 330. Alternatively, the seal 328 may be bonded within the groove 330. In another embodiment, the seal 328 may be a solid ring, as illustrated in FIG. 9. In such an embodiment, the seal 328 may be frictionally held within and/or bonded within the groove 330.

The seal 328 is positioned between the flange surface 316 of the connector housing 310 and the flange side 322 of the panel 320. The seal 328 creates a water tight interface between the connector housing 310 and the panel 320. The seal 328 is configured to prevent liquids, such as water and/or chemicals from entering the connector 302. Alternatively, the seal 328 may create an air tight interface between the connector housing 310 and the panel 320. The seal 328 provides electromagnetic shielding between the connector housing 310 and the panel 320.

The connector 304 is joined to a substrate 350 that includes an electrical contact 352 joined thereto. The electrical contact 352 is configured to engage the electrical contact 308 of the connector 302. The connector 304 includes a housing 354 having a flange 356 and a mating end 358. The flange 356 includes a flange surface 360. The mating end 358 of the connector housing 354 extends from the flange 356. The mating end 358 has an opening 362 extending therethrough. The electrical contact 352 extends into the mating end 358 and is accessible through the opening 362 formed in the mating end 358. The mating end 358 of the connector 304 is received within the mating end 314 of the connector 302 so that the electrical contact 308 engages the electrical contact 308.

A panel 364 engages the flange 356 of the connector housing 354. The panel 364 has a flange side 366 and a mating side 368. The panel 364 is secured to the flange 356 of the connector housing 354 so that the flange side 366 of the panel 364 is positioned adjacent the flange surface 360 of the flange 356. An opening 370 extends through the panel 364. The mating end 358 of the connector housing 354 extends through the opening 370 formed in the panel 364. When the connector 302 is engaged with the connector 304, the mating side 368 of the panel abuts the front face 336 of the mating end 314 of the connector 302.

A flange seal 372 and a mating end seal 374 are joined to the connector housing 354. The flange seal 372 and the mating end seal 374 may be over-molded to the connector housing 354. Optionally, the seals 372 and 374 may frictionally engage the connector housing 354. Alternatively, the seals 372 and 374 may be bonded to the connector housing 354. In one embodiment, the seals 372 and 374 are formed from a conductive ethylene propylene diene monomer. Optionally, the seals 372 and 374 may be formed from a fluorosilicone rubber. In one embodiment, the seals 372 and 374 include metal particles. For example, the seals 372 and 374 may be impregnated with passivated silver plated aluminum particles. Optionally, the seals 372 and 374 may be formed from any suitable sealing material.

The flange seal 372 extends along the flange surface 360 of the connector housing 354. In the illustrated embodiment, the flange surface 360 includes a groove 376. The flange seal 372 is formed as an o-ring positioned within the groove 376. The flange seal 372 may be frictionally held within the groove 376. Optionally, the flange seal 372 may be bonded within the groove 376. The flange seal 372 is positioned between the flange surface 360 of the connector housing 354 and the flange side 366 of the panel 364. The flange seal 372 forms a water tight and/or air tight seal between the flange 356 of the connector housing 354 and the panel 364. The flange seal 372 provides electromagnetic shielding between the connector housing 354 and the panel 364.

The mating end seal 374 extends along the mating end 358 of the connector housing 354. The mating end 358 of the connector housing 354 includes an outer surface 378. The mating end seal 374 is joined to the outer surface 378 of the mating end 358. The mating end seal 374 may be frictionally retained on the outer surface 378. Optionally, the mating end seal 374 may be bonded to the outer surface 378 of the mating end 358. The mating end seal 374 may include ribs 380 (shown in FIGS. 12 and 13). The mating end seal 374 is positioned between the panel 364 and the mating end 358. The mating end seal 374 provides a water tight and/or air tight interface between the mating end 358 of the connector housing 354 and the panel 364. The ribs 380 formed on the mating end seal 374 are configured to reinforce the water tight and/or air tight interface between the connector housing 354 and the panel 364.

Figure 10:
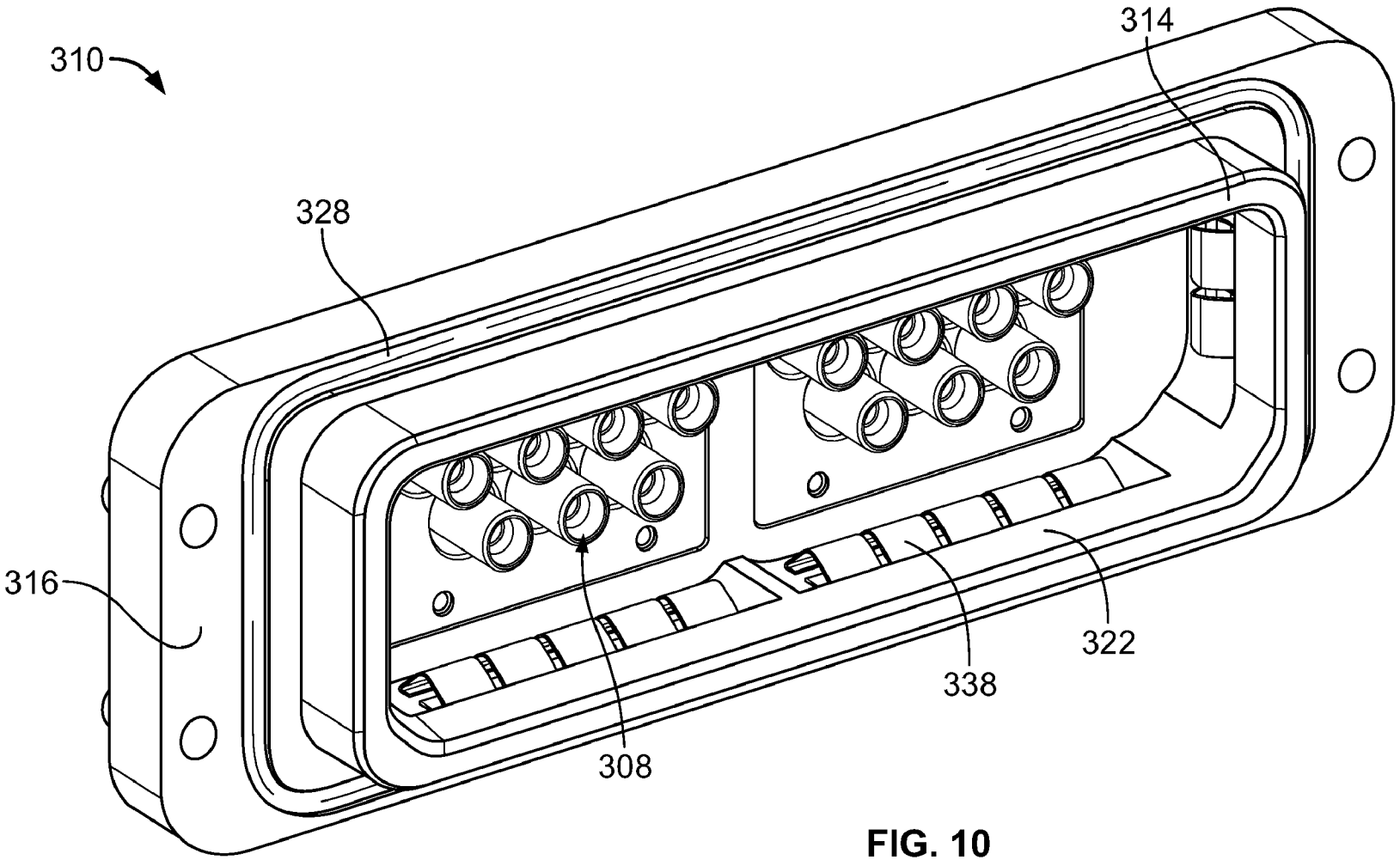
FIG. 10 is a view of one of the connector housings, shown in FIG. 7.
Figure 11:
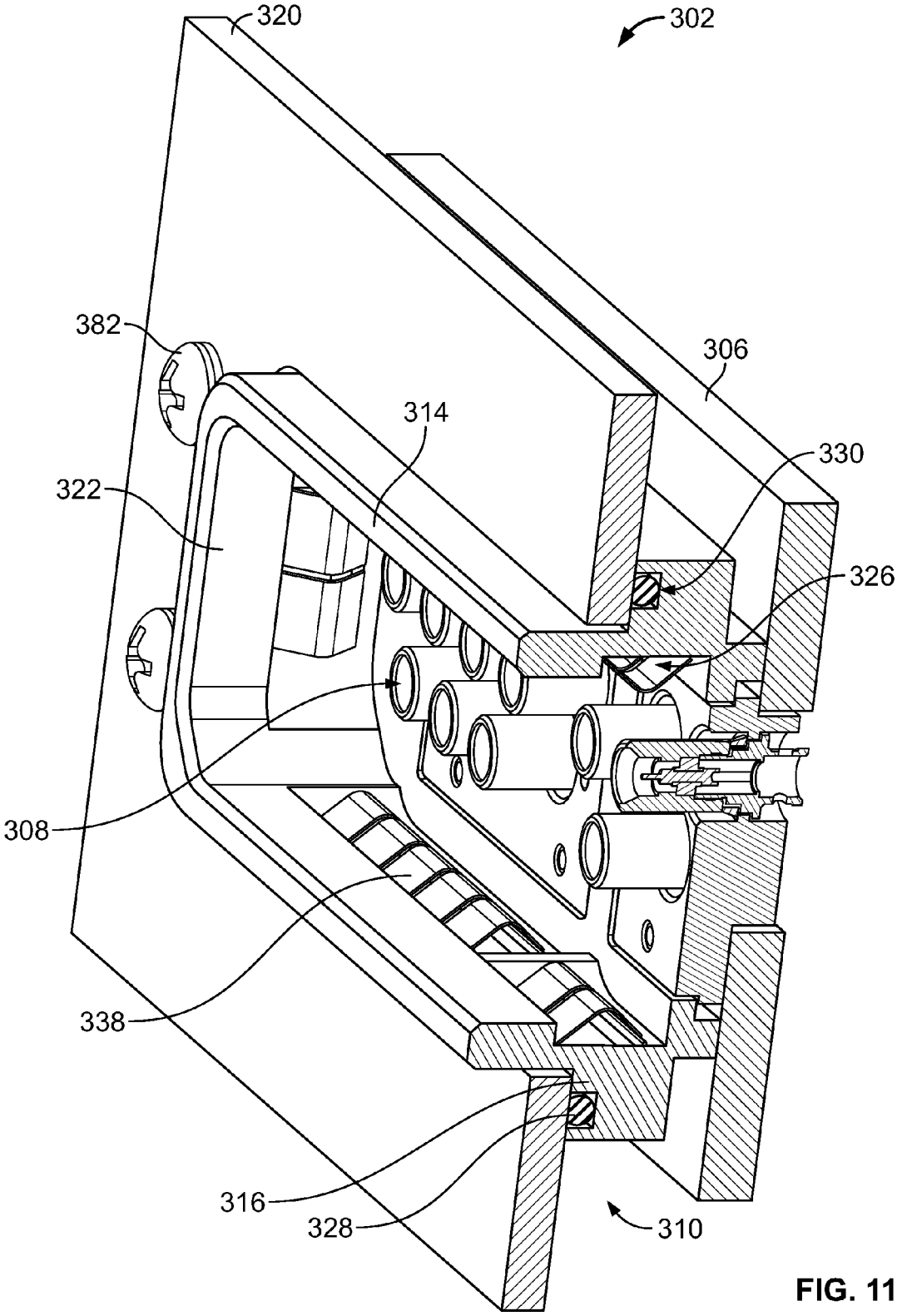
FIG. 11 is a cross-sectional view of one of the connectors, shown in FIG. 7, including the connector housing, shown in FIG. 10.

FIG. 10 illustrates the connector housing 310. FIG. 11 illustrates a cross-sectional view of the connector 302. The substrate 306 (shown in FIG. 11) extends parallel to the panel 320 (shown in FIG. 11). Alternatively, the substrate 306 may have any orientation with respect to the panel 320. The panel 320 is coupled to the connector housing 310 and sealed thereto with the seal 328. The seal 328 is retained within the groove 330 formed in the flange surface 316. The seal 328 creates a water tight interface around between the panel 320 and the flange surface 316 of the connector housing 310. The seal 328 prevents liquids from entering the electronic device. In one embodiment, the seal 328 creates an air tight interface between the panel 320 and the flange surface 316 of the connector housing 310. In the illustrated embodiment, the panel 320 is attached to the connector housing 310 with screws 382. Alternatively, the panel 320 may be press-fit, soldered, or the like to the connector housing 310.

The mating end 314 of the connector housing 310 extends through the opening 326 (shown in FIG. 7) formed in the panel 320 (shown in FIG. 7). The electrical contact 308 is housed within the mating end 314 of the connector housing 310. The electrical contact 308 is configured to engage the electrical contact 352 of the connector 304. The contacts 338 are positioned around the inner surface 322 of the mating 314. The contacts 338 are configured to engage the mating end 358 of the connector 304. When the connector 302 engages the connector 304, the mating end seal 374 of the connector 304 is configured to engage the inner surface 332 of the mating end 314 to form a water tight and/or air tight interface between the connector 302 and the connector 304.

Figure 12:
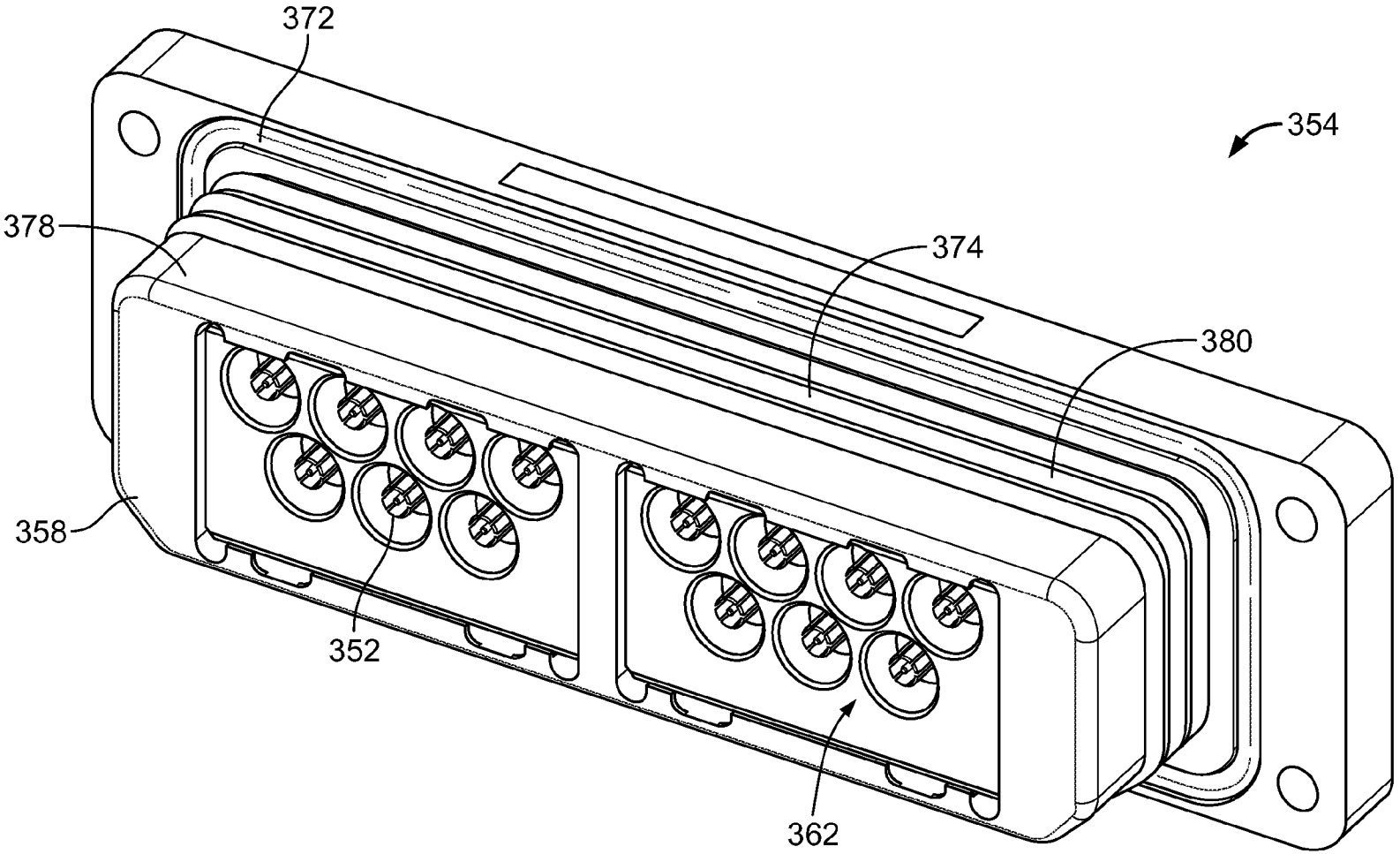
FIG. 12 is a view of the other connector housing, shown in FIG. 7.
Figure 13:
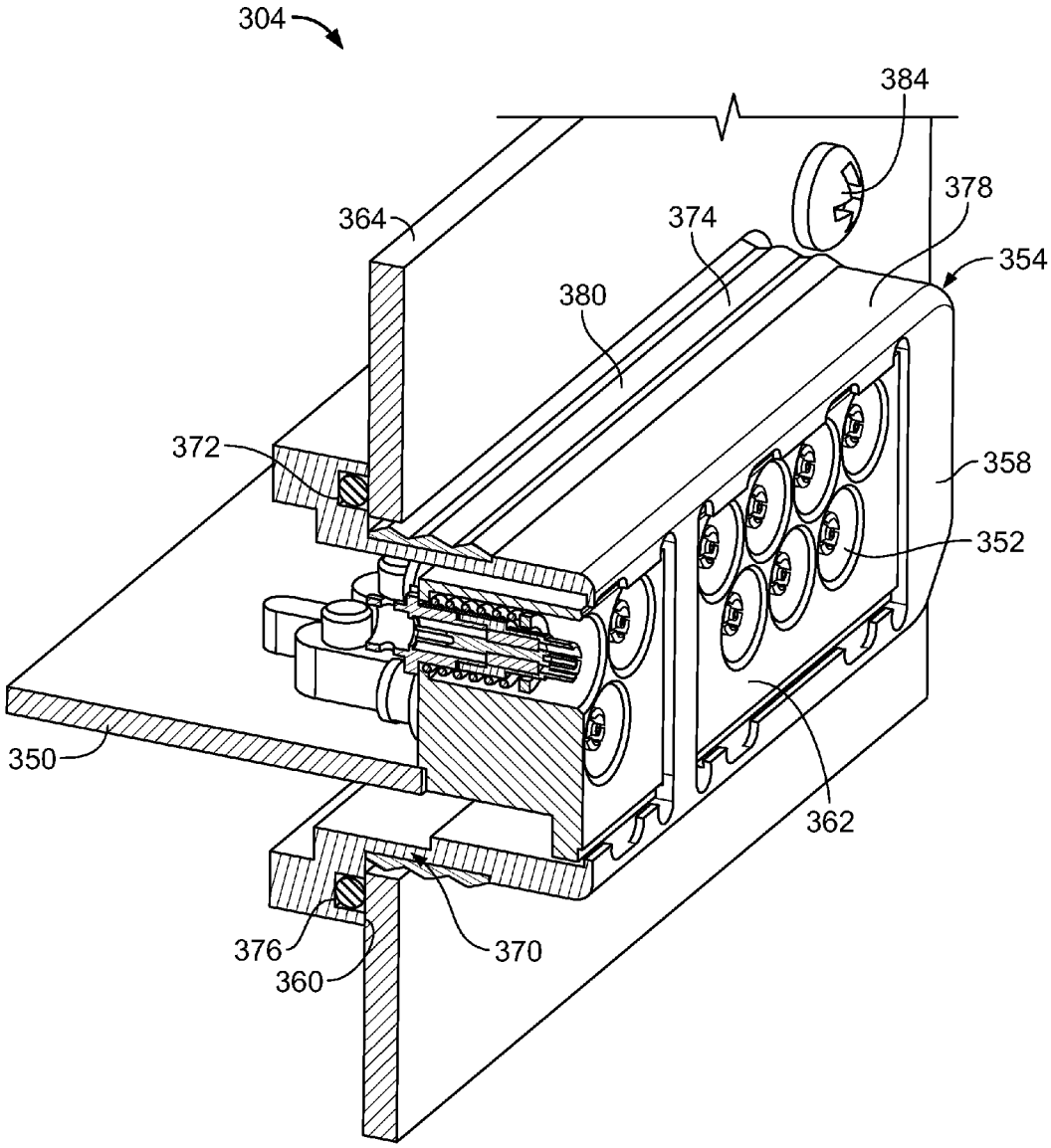
FIG. 13 is a cross-sectional view of the other connector, shown in FIG. 7, including the connector housing, shown in FIG. 12.

FIG. 12 illustrates the connector housing 354. FIG. 13 illustrates a cross-sectional view of the connector 304. The connector 304 is assembled so that the substrate 350 (shown in FIG. 13) is positioned perpendicular to the panel 364 (shown in FIG. 13). Alternatively, the substrate 350 may be aligned in any orientation with respect to the panel 364. The panel 364 is secured to the connector housing 354 with screws 384. Alternatively, the panel 364 may be press-fit, soldered, or the like to the connector housing 354. The mating end 358 of the connector housing 354 extends through the opening 370 formed in the panel 364. The panel 364 and the connector housing 354 are sealed by the flange seal 372. The flange seal 372 is retained within the groove 376 formed in the flange surface 360. The flange seal 372 creates a water tight interface around between the panel 364 and the flange surface 360 of the connector housing 354. The flange seal 372 prevents liquids from entering the electronic device. In one embodiment, the flange seal 372 creates an air tight interface between the panel 364 and the flange surface 360. The mating end seal 374 provides a water tight interface between the outer surface 378 of the mating end 358 of the connector housing 354 and the panel 364. Alternatively, the mating end seal 374 forms an air tight interface between the connector housing 354 and the panel 364.

The mating end 358 of the connector housing 354 surrounds the electrical contact 352. The electrical contact 352 is positioned within the opening 362 formed in the mating end 358 of the connector housing 354. The electrical contact 352 is configured to engage the electrical contact 308 of the connector 302. When the connector 302 is engaged with the connector 304, the mating end seal 374 is configured to engage the mating end 314 of the connector 302 to form a water tight and/or air tight interface between the connector 302 and the connector 304. In the illustrated embodiment, the mating end seal 374 includes the ribs 380 to provide improved sealing.

Figure 14:
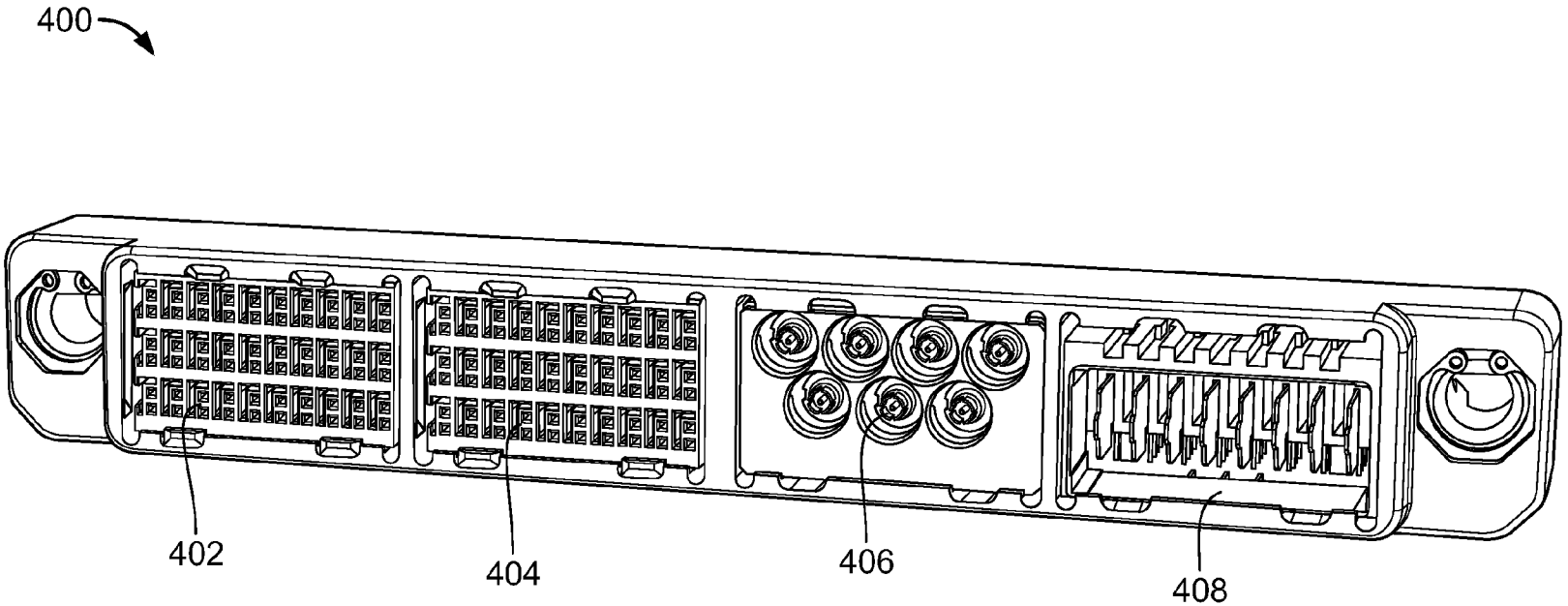
FIG. 14 is a view of an electrical contact formed in accordance with an embodiment and that may be used with the connector assemblies shown in FIGS. 1 and 7.

FIG. 14 illustrates an exemplary electrical contact 400. The electrical contact 400 may be utilized with the connector assembly 50 or the connector assembly 300. The electrical contact 400 is exemplary only. It should be noted that any number of electrical contacts may be utilized with the connector assembly 50 or the connector assembly 300. The electrical contact 400 includes four connectors. A first connector 402 and a second connector 404 are configured as high speed differential pair inserts. Alternatively, the first connector 402 and the second connector 404 may be configured as open field/single ended inserts. A third connector 406 is configured as a 7 SMPM coaxial module. A fourth connector 408 is configured as a power insert. Alternatively, the connectors 402, 404, 406, and 408 may be configured as any suitable type of module and/or insert. Optionally, the electrical contact 400 may include any number of connectors.

The embodiments described herein provide a high speed ruggedized connector for an electronic device. The connector provides shielding against liquids that may come in contact with the electronic device. The connector also provides EMI shielding for the electronic device.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted flanged on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A connector assembly comprising:

a connector having a connector housing including a flange and a mating end having a front face at a distal end of the mating end, the mating end extending from the flange, the flange having a flange surface, the mating end having an opening configured to receive an electrical contact therethrough;

a flange seal extending along the flange surface; and a mating end seal formed integrally with the flange seal, the mating end seal being provided at the front face of the mating end of the connector housing, wherein the connector housing is configured to couple to a panel so that a flange side of the panel is positioned adjacent the flange surface of the connector housing, the mating end of the connector housing is configured to extend through an opening formed in the panel, the flange seal is configured to be positioned between the flange surface of the connector housing and the flange side of the panel.

2. The connector assembly of claim 1, wherein at least one of the flange seal or the mating end seal comprises metal particles to provide electromagnetic shielding for the electrical contact.

3. The connector assembly of claim 1 further comprising a second connector configured to engage the connector, the second connector having a second connector housing configured to be coupled to a second connector panel, a second connector seal is configured to be positioned between the second connector panel and the second connector housing, the mating end seal being configured to engage and seal against the second connector.

4. The connector assembly of claim 1, wherein the mating end seal is configured to seal a panel of a second connector.

5. The connector assembly of claim 1, wherein the mating end seal further comprises ribs to seal the mating end of the connector to a second connector.

6. The connector assembly of claim 1, wherein the mating end of the connector includes electrical contacts to provide electromagnetic shielding for a second connector that is configured to engage the mating end of the connector.

7. The connector assembly of claim 1, wherein the flange of the connector housing includes a groove, the flange seal retained within the groove.

8. The connector assembly of claim 1, wherein the mating end seal is configured to be positioned between the panel and the mating end of the connector housing to seal the opening of the panel.

9. The connector assembly of claim 1, wherein the mating end seal is configured to be positioned between the front face and a second panel different from the first panel.

10. A connector assembly comprising:

a connector having a connector housing including a flange and a mating end extending from the flange, the flange having a flange surface, the mating end having an opening configured to receive an electrical contact therethrough; and a seal joined to the mating end and the flange of the connector housing and configured to seal the connector housing to a panel, the seal comprises metal particles to provide electromagnetic shielding for the electrical contact, wherein the connector housing is configured to be coupled to the panel so that a flange side of the panel is positioned adjacent the flange surface of the connector housing, the mating end of the connector housing configured to extend through an opening formed in the panel; and wherein the seal is configured to engage and seal against a second connector assembly mated to the connector.

11. The connector assembly of claim 10 further comprising a second connector configured to engage the connector, the second connector having a second connector housing configured to couple to a second connector panel, a second connector seal is configured to be positioned between the second connector panel and the second connector housing.

12. The connector assembly of claim 11, wherein the second connector seal comprises metal particles to provide electromagnetic shielding for the second connector.

13. The connector assembly of claim 10, wherein the seal further comprises ribs to seal the mating end of the connector to a second connector.

14. The connector assembly of claim 10, wherein the mating end of the connector includes electrical contacts to provide electromagnetic shielding for a second connector that is configured to engage the mating end of the connector.

15. The connector assembly of claim 10, wherein the second connector assembly comprises a second connector and a second panel; the seal being configured to engage and seal against at least one of the second connector and the second panel.

16. A connector assembly comprising:

a first connector having a connector housing including a flange and a mating end extending from the flange, the flange having a flange surface, the mating end having an opening configured to receive an electrical contact therethrough;

a flange seal extending along the flange surface;

a mating end seal formed integrally with the flange seal, the mating end seal extending around the mating end of the connector housing, wherein the first connector is configured to couple to a first panel so that a flange side of the panel is positioned adjacent the flange surface of the connector housing, the mating end of the connector housing is configured to extend through an opening formed in the panel, the flange seal is configured to be positioned between the flange surface of the connector housing and the flange side of the panel; and a second connector configured to engage the first connector, the second connector having a second connector housing configured to couple to a second panel, a second connector seal is configured to be positioned between the second connector panel and the second connector housing;

wherein the mating end seal is configured to engage and seal against at least one of the second connector housing and the second connector panel.

17. The connector assembly of claim 16, wherein at least one of the flange seal or the mating end seal comprises metal particles to provide electromagnetic shielding for the electrical contact.

18. The connector assembly of claim 16, wherein the second connector seal comprises metal particles to provide electromagnetic shielding.

19. The connector assembly of claim 16, further comprising electrical contacts formed in at least one of the first connector housing or the second connector housing, the electrical contacts configured to provided electromagnetic shielding for the first connector and the second connector.

20. The connector assembly of claim 16, wherein the mating end seal engages and seals against the second panel.

* * * * *